US005669811A

United States Patent [19]

Zaniewski

[11] Patent Number: 5,669,811

[45] Date of Patent: Sep. 23, 1997

[54] MODULAR DEVICES FOR THE EXTRACTION OF FUMES

[76] Inventor: Michel Zaniewski, Avenue Ferdinand de Lesseps, 34110 Frontignan, France

[21] Appl. No.: 328,825

[22] Filed: Oct. 25, 1994

[30] Foreign Application Priority Data

Oct. 25, 1993 [FR] France ..... 93 13024

[51] Int. Cl.[6] ..... F23L 17/02

[52] U.S. Cl. ..... 454/16; 454/38; 454/39

[58] Field of Search ..... 454/38, 16, 35, 454/39

[56] References Cited

U.S. PATENT DOCUMENTS

| | | | |
|---|---|---|---|
| 3,345,931 | 10/1967 | Walsh | 454/38 |
| 4,142,457 | 3/1979 | Zaniewaski | 454/38 |
| 4,200,035 | 4/1980 | Zaniewski . | |
| 4,342,258 | 8/1982 | Zaniewski | 454/38 X |

*Primary Examiner*—Harold Joyce
*Attorney, Agent, or Firm*—Horst M. Kasper

[57] ABSTRACT

A smoke extraction apparatus consists essentially in a structural shape of a type of a molding plane given to the exterior wall of the footing (2), which forms the common base element of the static module and of the dynamic module. The dynamic module can be indiscriminately associated to the footing (2) according to the climatic conditions of the location or according to the desired level of underpressure, wherein the dynamic module is formed by a ferrule (15) made of a lower cylindrical part (16), which lower cylindrical part (16) extends in the upward direction in a truncate-cone part (17), where the truncated-cone part (7) ends in a turned-down exterior edge (18). The ferrule (15) is also formed surrounding the turbine (13) and is surmounted by the truncated-cone muffle (19), where the small base of the truncated-cone muffle (19) is extended upwardly in a neck (21), which neck (21) surrounds the electric motor (14), where the electric motor (14) keeps the turbine (13) in motion.

21 Claims, 6 Drawing Sheets

MODULAR DEVICES FOR THE EXTRACTION OF FUMES

Figure 3:
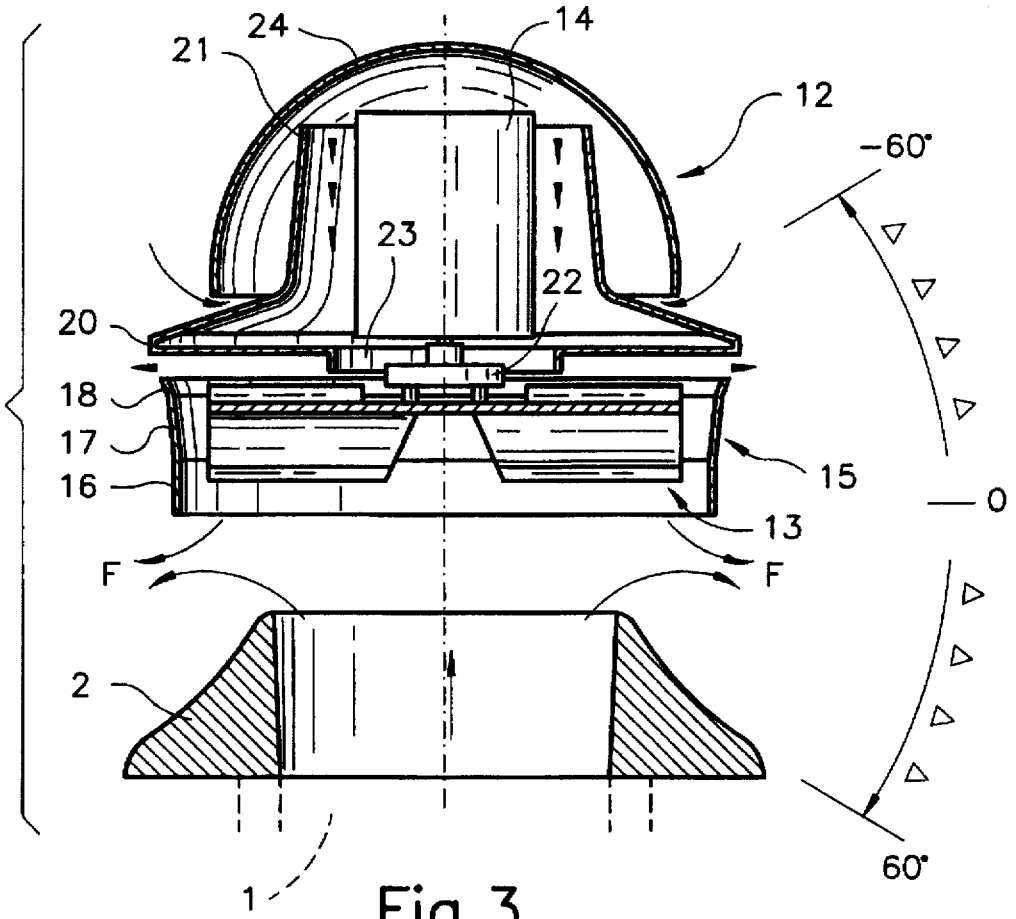

A ventilator for use or a conduit having an upwardly open mouth is taught in the U. S. Pat. 4,342,258. A fan generates a downwardly flowing air stream.

A modular device for the maintaining and for the controlling of a low-pressure zone at an opening of a duct for ventilation or for the extraction of smoke has been the subject matter of the French Patent No. 85-08697, filed by the applicant on Jun. 3, 1985.

The device includes a static member of a general shape of a truncated cone with rounded steps, which generates a low-pressure zone in the duct or at the top of the duct onto which the static member was placed, based on the effect of the wind alone, which wind sweeps through the static member, which forms such a static module of the system as to allow connecting a mechanical ventilation module, which mechanical ventilation module, in the absence of wind or for obtaining a larger low-pressure zone, generates at the level of the static member an artificial air current or supplies the wind required for obtaining the low-pressure zone necessary for the evacuation of the smoke or for the ventilation of the building according to the standards, which were required at the date of filing of the French Patent No. 85-08697.

This assembly of two modules forms a mechanostatic ventilation group.

However, the requirements regarding the furnishing of extraction equipment for fumes and of ventilation equipment for apartment buildings or industrial buildings increase continuously in view of improving the safety and in view of reducing the cost of the installation. Thus, the performance of this type of equipment is in fact the object of the French standard AFNOR P-50413 of August 1993.

Modifications of the structure and of the form of the apparatus created previously became necessary in order to satisfy this new standard. Modifications of the structure and of the form are the result of a lengthy aerodynamic research, where the importance of the results can only be stated in the course of experiments and tests effected in wind tunnels in specialized laboratories. Such differences of the form, which can in fact appear to be relatively small structurally, nevertheless give important aerodynamic results which are only confirmed in the course of the tests.

The aerodynamic results are revolutionary even if the newly proposed forms may not appear revolutionary.

These are the new results, which are obtained by the use of forms which are described below and which constitute the invention elements, where the invention relates to a modular device including a base module formed by static members, which static members are placed on top of a ventilation duct or on top of a ventilation chimney, which static members generate a low-pressure zone in the interior of the duct or of the chimney by a simple Venturi effect under the influence of the wind which is sweeping through the duct or chimney, wherein the yield is based on the newly adapted shape as will be seen below.

A module thus equipped can be sufficient in many situations. In other situations, for example in the absence of wind, the natural low-pressure zone obtained in this way can be insufficient and a new mechanical ventilation module can be attached with the purpose of obtaining a constant low-pressure zone based on the artificial wind, which is generated by the new mechanical ventilation module, wherein this mechanical ventilation module is characterized in that its essentially mechanical elements are combined together with members, which themselves participate in the effectiveness of the mechanical static system provided in this way.

However, such a system allows, when the conditions of local air flow and ventilation permit, to use only the static module. Such system allows further, when the mechanical static assembly is in place, to use the mechanical member at will or automatically, be it either as a result of the absence or the insufficiency of the wind or by increasing the effect of the wind, knowing that the presence of the mechanical module does not damage the effectiveness of the base static members.

Thus, the invention relates to new aerodynamic forms given to various elements of each of these modules, where the new results, obtained during technical tests performed in wind tunnels at the Eiffel laboratories, depend on the new aerodynamic forms, and where the diagrams collected in these technical tests are given here and show the progress thus obtained in order to comply with the new requirements.

The modular device forming the object of the invention includes essentially a static module composed of a footing, placed at the top of a ventilation duct or of a smoke extraction duct and having from the outside a shape of a truncated cone, which is characterized in that the outer wall assumes a particular shape of the molding plane in order to allow at this level an outflow of laminar air, which outflow of laminar air in cooperation with an upper plate, placed at a convenient distance from the truncated-cone-shaped element, creates a Venturi effect, where the venturi effect generates the desired low-pressure zone in the duct thus equipped, where the effectiveness of this assembly is a result of particular forms, which characterize each of these elements such as they are described in detail below.

Such a device fits in a sufficient way in order to assure a zone of an underpressure of from 2 to 20 Pa in the duct during the winter season.

In certain other cases, the static assembly alone does not prove to be sufficient, be it temporarily, based on the absence of wind, or be it in a permanent way in the case, where a larger depression of from about 30 to 300 Pa appears necessary.

It is in order to respond to particular conditions that the footing of the truncated cone forms the base element of the static modular apparatus and can be associated with various additional elements, which comprise amongst others a mechanical ventilation member driven by an electric motor, which elements are described below and which form the mechanical module, which mechanical module contributes to generate an artificial air current, which air current is capable of substituting the wind or which air current is capable of adding to the wind for obtaining a Venturi effect, which assures in all circumstances the desired depression.

Thanks to its proper static elements, the addition of this mechanical module to the static base module, since its mechanical member is in a static position, practically does not modify the depression results obtained under the same atmospheric conditions with the static module alone, when the mechanical member of the mechanical module is stopped.

The invention is additionally characterized by the details which are given and configured by way of an example.

Figure 1:
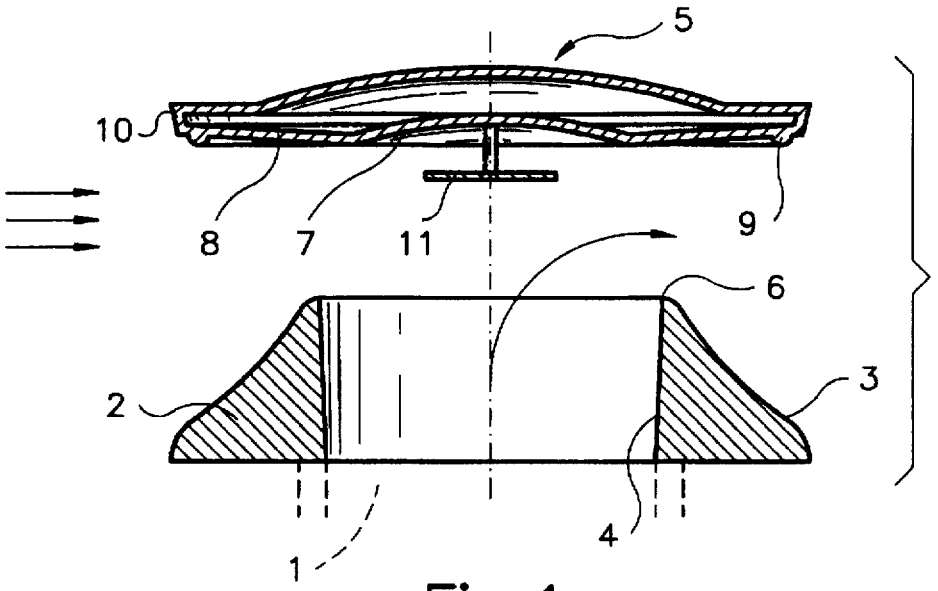

FIG. 1 is a schematic view of a vertical diametrical section of the static base module.

Figure 2:
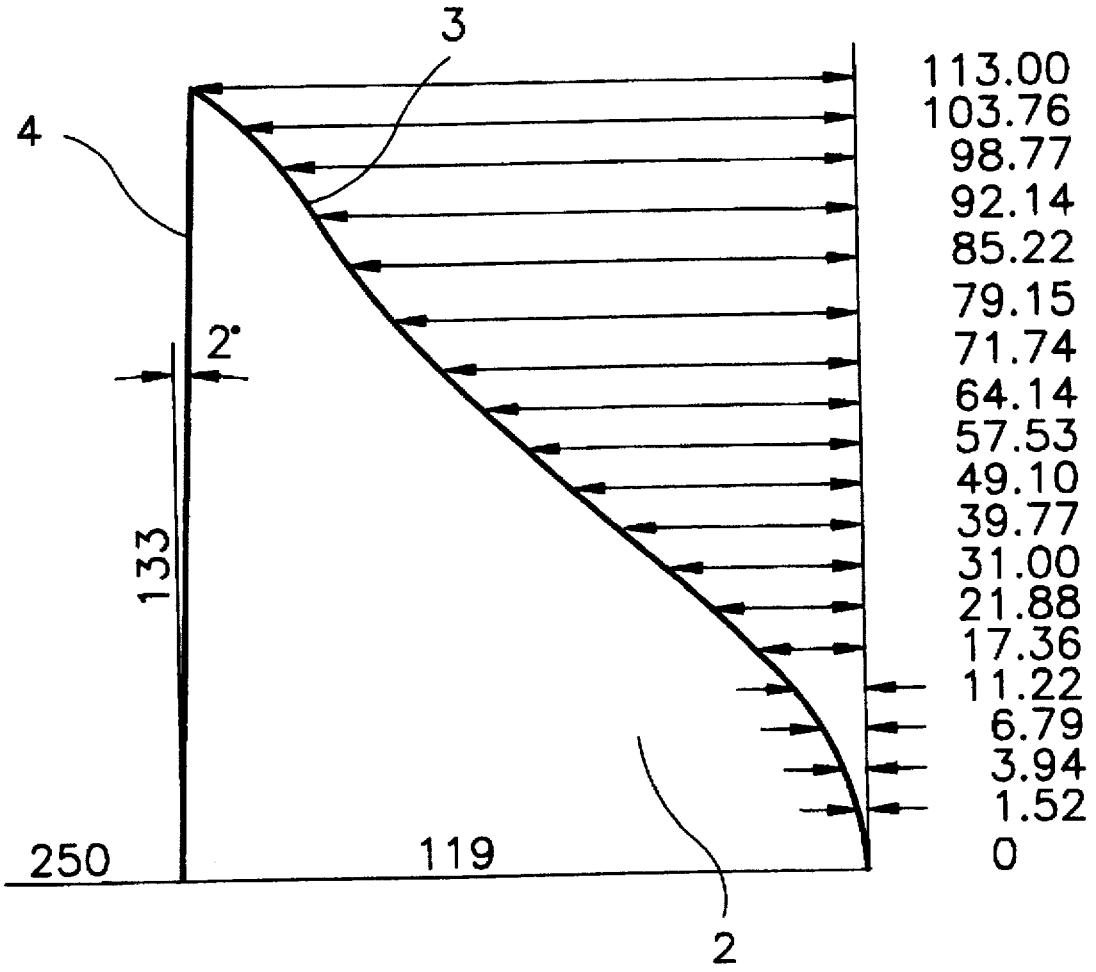
Figure 8:
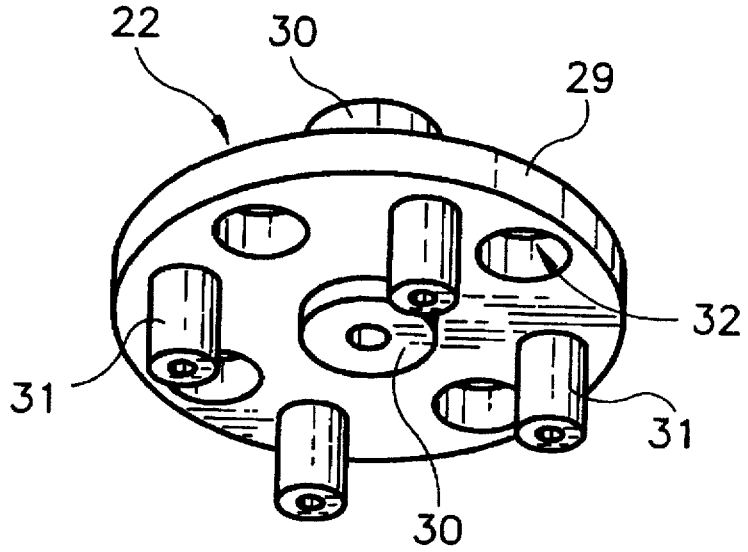
Figure 4:
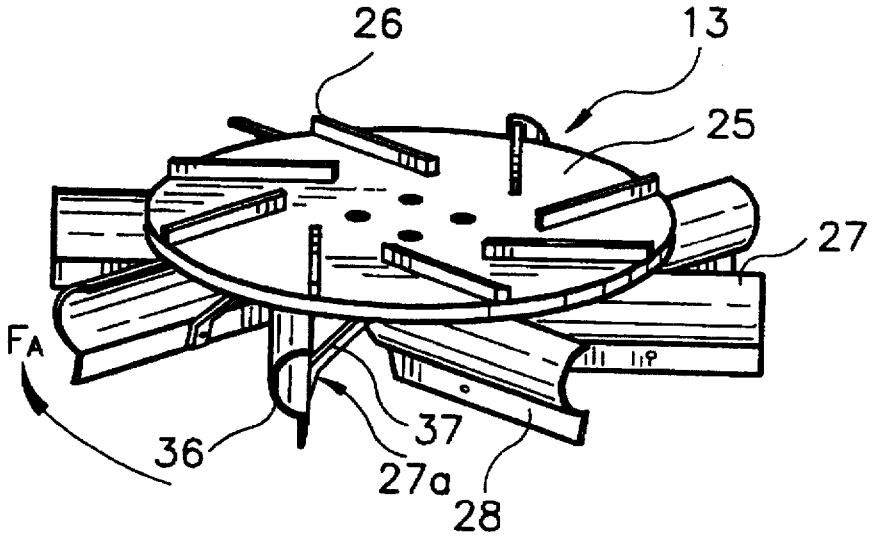
Figure 5A:
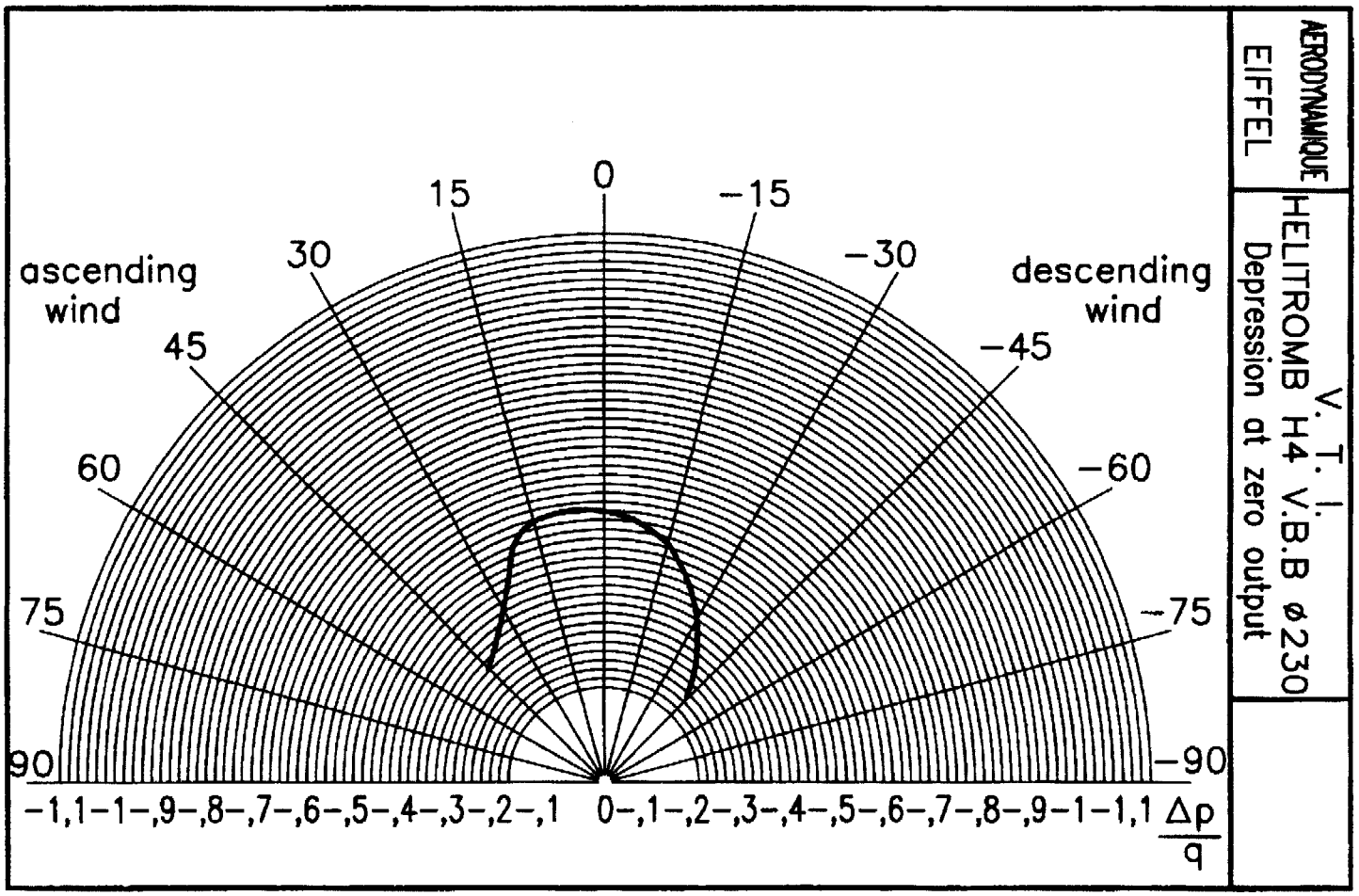
Figure 5B:
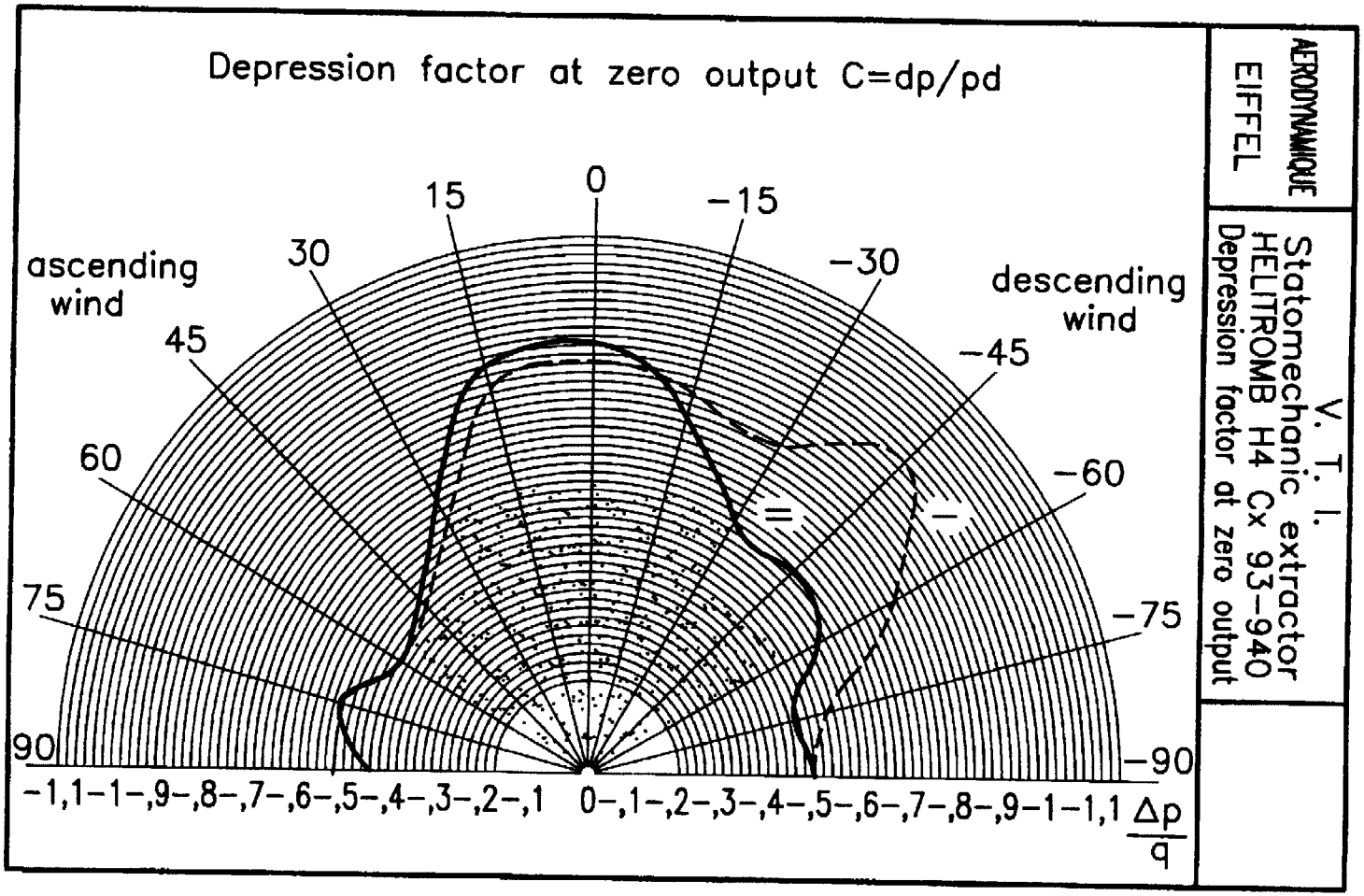
Figure 6:
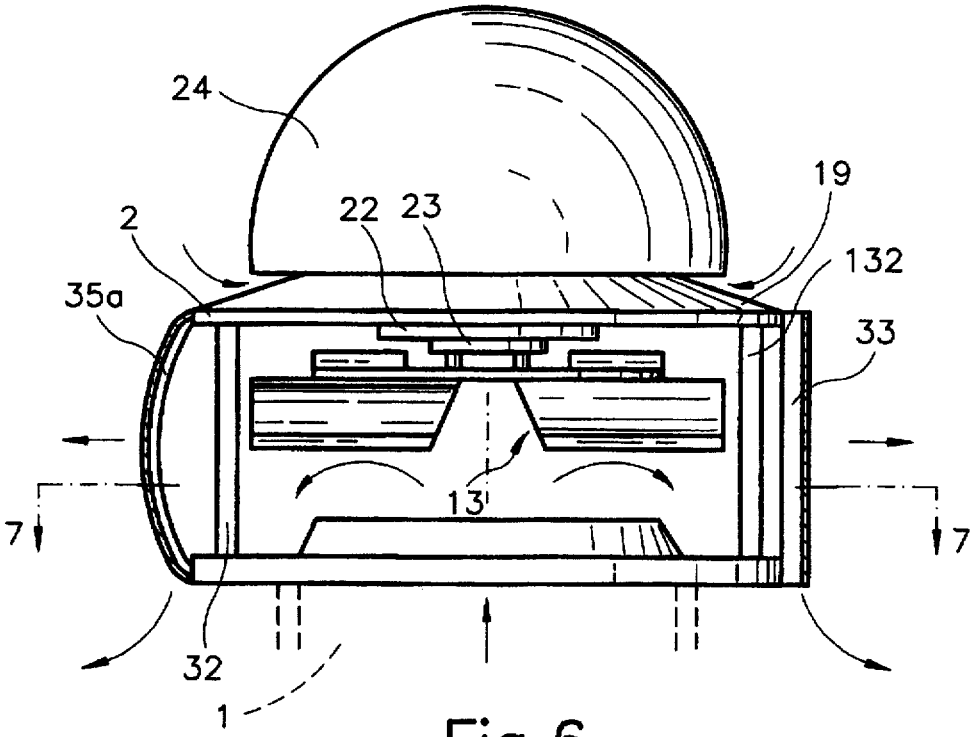
Figure 7:
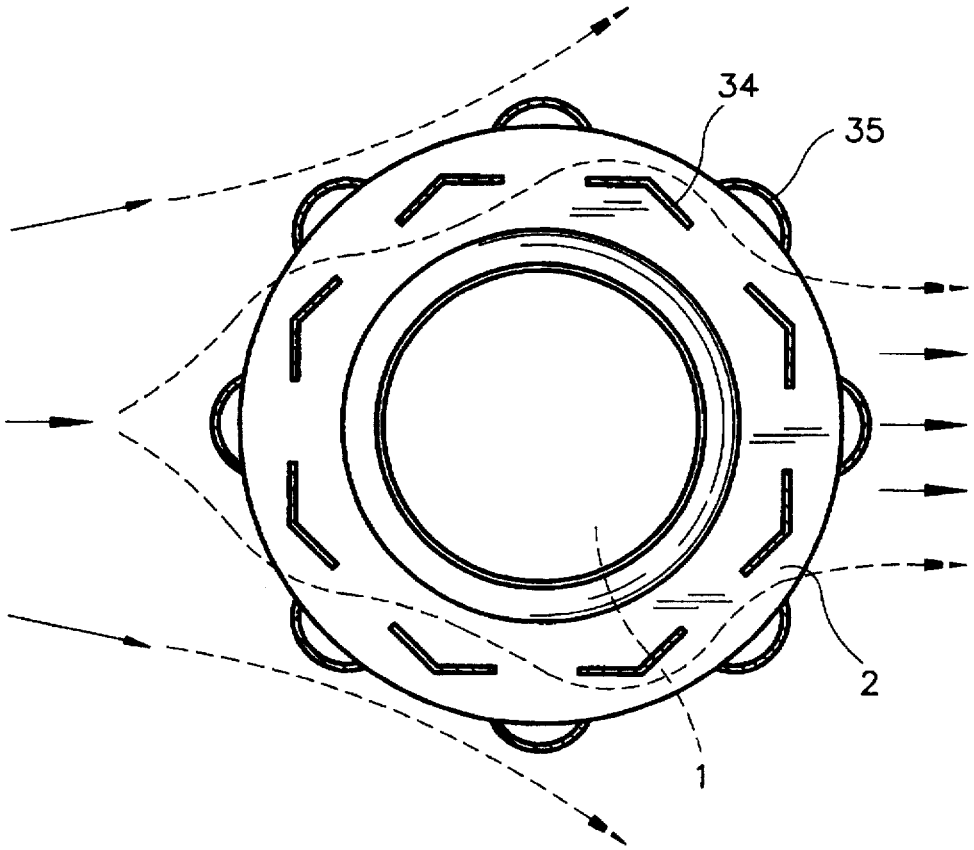

FIG. 2 is a partial view of a vertical diametrical section of the footing contained in that static module, FIG. 3 is a schematic view of a vertical diametrical section of the mechanical module which is capable of cooperating with the footing, FIG. 4 is a schematic perspective view of the opened centrifuge turbine which forms the mechanical element of the system, FIG. 5*a* is a diagram of the depressions which show the results obtained under different wind directions by means of the device of the prior patent above recited, FIG. 5*b* is a diagram of the depressions showing the results obtained under different wind directions by means of the device which forms the present invention object, FIG. 6 is a schematic elevational view of a variation of the mechanical module, where the casings which form the mechanical module are shown alone in a vertical diametrical section, FIG. 7 is a schematic sectional horizontal view along section line 7—7 of the variation of FIG. 6, FIG. 8 is a perspective view from below of the device for the coupling of the electric motor and the turbine which allows to reduce the thermal bridge between the two members.

The ventilation duct or the smoke extraction duct is covered at the level of its upper orifice by the footing 2, formed by a ring exhibiting an interior diameter, which interior diameter is at least equal to the diameter of the conduit 1 and which presents its outside wall in a general form of a truncated cone as shown in FIG. 1, which truncated cone is characterized in that it assumes a form of the molding plane 3, where the flow, which is the result of experimentation and which does not correspond to any simple mathematical equation, can be defined by FIG. 2. It is specified that the values which are thereby obtained are those which have been seen to assure, with the elements forming FIG. 1, the results proven by the diagram I of FIG. 5*b*, for a given diameter of the duct 1, wherein each complete homothetic form benefits from the same study.

The shape of the molding plane corresponds approximately to a truncated cone face opening to the bottom and exhibiting an average angle from about 30° to 60° and preferably of about 45°, where the opening angle of the cone is larger than the average angle in a middle zone, and where the opening angle of the cone is smaller in an upper end zone and in a lower end zone, wherein the cone face presents a continuous and smooth curve when considered in a sectional view.

The internal wall 4 is slightly conical and opened in an upward direction in the proportions and relations also given by FIG. 2.

The horizontal plate 5 is placed above the opening of the footing 2 at such a height level with respect to the footing 2 that the surface of the imaginary cylindrical ring, enclosed between the upper edge 6 of the footing 2 and the lower face of said plate, is at least equal to one and a half times the surface of the upper orifice of said footing.

The plate 5, where the diameter of the plate 5 is substantially equal to the outer diameter of the footing, comprises a spherical cap 7 with a small concave face bordered by a ring collar 8 at the lower surface of the plate 5 at its center, which ring collar 8 is slightly conical, and which ring collar 8 opens towards the exterior of the device, where the ring collar 8 is bordered by a circular snap ring 9.

The outer peripheral wall 10 of said plate presents a conical opening in upward direction.

The concave cap 7 carries at its center a deflection face 11, which deflection face 11 is held in a rigid manner at a distance substantially equal to two times the deflection or bulging depth of this concave cap 7.

The static assembly, which is formed in this way, allows to obtain the corresponding depressions, depending on the orientation of the winds in a horizontal direction, as seen at the curve I resulting from tests of this device performed by the Eiffel laboratory under the winds which vary from −90° to +90° relative to the horizontal plane.

The French standard P-50413 foresees that the depression factor at the output nil (C=dp/pd) for a determined static member should not be less than −0.65 for the winds oriented in a direction of −30° to +30°, and should not be lower than 0.5 for the winds oriented in a direction −60° to +60° (gray zones), as can be determined on the diagram of FIG. 5*b* by observing the curve I, which curve I corresponds to the using of the above described static elements. If the standard tangents the limited zones authorized for the rising winds between +60° and +30° (rare cases), the standard generates depressions which are much higher than the minimum standard required in the zone of rising winds from 30° to 0° as well as for the descending winds from 0° to −60°. These advantageous results are in addition maintained even until the winds descend below −75°. They conform to class B of the French standards.

It is noted for the orientations from +20° to −20°, which orientations are the most frequent orientations of the winds, i.e. at 0.84, that the average depression factor is established. More particularly, it can be noted that for the orientation 0°, which corresponds to a horizontal wind, the depression factor passes through a maximum of 0.95. These results show that the new configurations given for each of the elements meet the most exacting norms, which are presently published.

The static module includes the elements above described (FIG. 1), regardless of the proper efficiency of the static module during the venting time, which efficiency may not turn out to be sufficient for an active ventilation in the absence of a wind and in the absence of a thermal complimentary effect in the duct.

Therefore, the mechanical module 12 was structured to be added and joined to the footing 2 (FIG. 3) to replace the plate 5, with the goal that the depression resulting from the artificial wind generated by the opened centrifuge turbine 13, which centrifuge turbine 13 is a part of the mechanical module 12, and which centrifuge turbine 13 is driven by the electric motor 14, supplies the depression generated by the natural wind at the level of the static elements formed in this case by the footing 2, where the footing 2 cooperates in this case with the new static elements contained in the mechanical module 12 itself, such as the ferrule 15, which ferrule 15 limits and circumscribes said turbine 13 and the muffle 19, which is mounted on this turbine 13.

By recording the above recited tests and principles, one has obtained similarly the improvement of the low-pressure zone generated by the footing 2 thanks to the new shape of the footing 2 and, in the same way, the new shapes given to the static elements (the ferrule 15 and the muffle 19 which is associated with the ferrule 15) of the mechanical module 12 allow to maintain these results when these 2 modules, mechanical and static, are associated, and when the turbine 13 is at a standstill.

For this purpose, the ferrule 15, which surrounds the turbine 13, is furnished at its base with the form of a cylindrical collar 16, which cylindrical collar substantially constitutes one third of the height of the ferrule 15.

The cylindrical collar 16 is surmounted by a truncated cone 17, which is slightly opened toward the top at a height level which is substantially equal to half the height of the ferrule 15, and which ends at the level of its upper edge by the border turned down to the outside 18, which presents an enlarged tapered cone.

The diameter of the collar 16 is substantially equal to 8/5 of the interior diameter of the footing 2. The position of the collar 16 relative to the footing 2 is such that the peripheral surface of the cylindrical imaginary ring, comprised between the lower surface of the ferrule 15 and the surface of the upper orifice of the footing 2, is substantially equal to 1½ times the surface of the opening of the footing 2.

The ferrule 15 which is open at each of its ends is surmounted by the muffle 19, which muffle 19 exhibits a cone opened toward the bottom based on an angle, which is substantially obtuse, and where the lower diameter of the muffle 19 is substantially larger than the upper diameter of the ferrule 15. The muffle 19 ends at its base in a vertical shoulder edge 20 disposed at the base of said muffle 19, which muffle 19 is opened only up to the level of the cylindrical collar 23. The upper opening of the muffle 19 ends in a neck 21 which maintains an air circulation around the electrical motor 14, which electrical motor 14 is disposed at the center of the muffle 19, and which electrical motor drives the turbine 13 by means of the heat-resistant coupler 22, which heat-resistant coupler is located at the interior of said cylindrical collar 23. The cylindrical collar 23 turns the smoke away in case of windy weather in order to avoid its penetration into the muffle 19 and, beyond that, in order to avoid a dirt accumulation at the motor 14 and in the space wherein the motor is contained. Said coupler avoids that the heat of the turbine 13, which turbine 13 stirs up the hot smoke, is not transmitted to the motor 14 and does not cause a deterioration of the motor 14.

The motor 14 and the neck 21 are covered by the dome-shaped cover 24 in the form of a hemispherical cap disposed such as to allow a space between the upper truncated-cone wall of the muffle 19 and the lower edge of the dome-shaped cover 24 with the purpose of allowing the air to penetrate the muffle 19 along the deflections for cooling the motor.

The opened centrifuge turbine 13, which is specifically shown in FIG. 4, carries the rectangular blades 26 of a small height with respect to their length in an oblique angle position relative to the radius of said plate and in a position of leakage relative to its rotation sense indicated by the arrow $F_A$, where the rectangular blades 26 are solidly connected to the upper surface of the plate 25 of the opened centrifuge turbine 13. The principal blades 27 are disposed at the lower surface of the plate 25, and the principal blades 27 are positioned in the same orientation relative to radii of the plate 25 as the upper rectangular blades 26. The principal blades 27 assume a particular form, which becomes clear in FIG. 4 at the level of the lower blade end section 27A, which is seen at the lower end of the principal blade 27.

Such as shown these principal blades 27 are substantially present under the form of a half cylinder 36, which is open in longitudinal direction, and which is fixed to the plate 25 at the level of its longitudinal upper edge and where the longitudinal lower edge 28 is flattened on the outside relative to the half cylinder substantially in the extension of the diameter of the half cylinder.

The bracket 37 is disposed and tensioned between the edge 25 of each plate 27 and the lower face of the plate 25 in order to avoid that the principal blades 27 do not open during their rotation at a high speed under the effect of the air pressure, which air moves the principal blades 27.

This new form given to the principal blades 27 not only simplifies the production but also allows an increase of 20% of the depression and of the output when the turbine 13 is put to rotate. On the other hand, the high aerodynamic configuration of the principal blades 27 allows to maintain the turbine 13 remote from the orifice of the footing 2 without reducing the effect of the turbine on this static member. This construction is associated with the advantage of authorizing an important space between the ferrule 15 which circumscribes said turbine 13 and the footing 2, which construction causes only slight losses of the feed in the outflow of the wind through the associated static elements once the turbine 13 is stopped and, in this way, the associated static elements also favorably participate in the overall static results of the device.

It is noted that the rectangular blades 26, which are situated on the upper face of the plate 25 of the turbine 13 contribute to the cooling of the motor 14 by aspiration across the collar 23 and the neck 21 with the air penetrating at the base of the dome 24, which air is thrown back across the space left between the muffle 19 and the ferrule 15.

The coupling 22 (FIG. 8) is formed by a disk 29 providing thermal isolation. A mandrel 30 with a central borehole is disposed on the upper face of the disk 29 at its center, and allows its coupling to the motor 14, and at least three support pillars 31 are disposed at its lower part, where the support pillars 31 are equally distributed on a relatively remote and distant circumference of the mandrel 30, and where the turbine 13 is fixed to the perforated mandrel 30. The perforations 32, which are furnished in the insulating disk 29, contribute to assure the dispersion of the heat carried by the smokes and transmitted to the turbine 13, where the turbine 13 stirs the smoke and which, without the presence of this coupling, causes the heating of the motor by means of the shaft of the motor.

Similarly as it is stated, the module 12 thus formed includes simultaneously a mechanical element formed by the opened centrifuge turbine 13 driven by the motor 14 and associated to an assembly of static elements formed by the ferrule 15, at the interior of which ferrule 15 said turbine is put to rotation, and by the muffle 19 and the dome 24 which, in cooperation with the footing 2 derived from the static module, form together a device capable of functioning together in a static mode benefiting from the energy of the wind, when the motor and the turbine are stopped or, in a mechanical mode situation, the motor and the turbine are in rotation in order to generate an artificial wind necessary to maintain the desired depression.

Thus, one recognizes based on the tests on the apparatus comprising both of the above described modules, where the results of these tests are shown in the curve II of the diagram of FIG. **5*b* in a purely static operation, where the turbine 13 is stopped, and where the depression factor obtained in the directions of wind being from +60° to −60° is very close to those obtained by the static members alone (FIG. 1) showing that the mechanical module 12, which has the advantage of being capable of generating, if necessary, an artificial wind in order to substitute for the lack of wind or to supply a wind, and that the mechanical module 12** does not interfere with the natural venturi effect of the system when the turbine is at a standstill.

These results are based on new forms given to each of the elements of each of the two modules, mechanical and static, and are to be compared practically with the diagram (FIG. **5*a*) of the tests performed under the same conditions by the same laboratory at the time of the study of the device described in the earlier French patent which is above recited and which was also filed by the present applicant, where the present application is an improvement of said earlier French patent. One notes in fact on the diagram (FIG. 5*a***) relating to the assembly of the elements such as they have been constructed and set forth in the previous patent, where the considerable improvement of the depression factor obtained by means of the object of the present invention, where the factor of the depression results at the average of 0.86 between +20° and −20°. Therefore, with the preceding forms given to each of the same elements, the depression factor was on the average only 0.55 and this only between +15° and −15°.

The depression values, obtained by the static elements only of the two modules associated, is already found very much superior in algebraic numbers to the values obtained by means of the forms previously adopted.

One understands that an artificial air stream will be created in the direction of arrow F in the absence of the wind and when the turbine is put in rotation, which artificial air stream will generate an effect of centrifugation and of venturi at the level of the orifice of the footing 2, which effect of centrifugation and venturi will cause a depression similar to the depression generated by the wind crossing the static members of the apparatus.

Thus, under slow rotation of the turbine, there will be created an underpressure similar to the underpressure, which is generated by the wind naturally crossing the static members of the apparatus and, by a rapid rotation of the turbine, there is obtained an underpressure, which is higher than the underpressure created by natural wind depending functionally on the speed of the rotation of the turbine. This allows the utilization of the apparatus for a very large area of ventilation needs or of draught needs under the conditions which are always higher to the standards which are actually required.

According to an alternate embodiment (FIG. 6) the ferrule 15, which surrounds the turbine, is replaced by two concentrically fixed cages 132 and 133, disposed on the footing and carrying the muffle 19 as well as the dome-shaped form 24.

The inner housing 132 is formed by the vertical dihedral bodies 34 exhibiting an obtuse angle, where the vertical dihedral bodies 34 are distributed around the turbine 13, where the chamfer of the vertical dihedral bodies is preferably directed toward the outside, and where the vertical dihedral bodies are regularly spaced one from another at a distance substantially smaller than the size of one of the vertical dihedral bodies. It is noted that in view of responding to different and specific requirements, the dihedral bodies 24 can be disposed along very different orientations.

The outer cage 133 is separated from the inner cage 132 and is formed by the vertical cylindrical structures 35 of a semicylindrical cross-section, wherein the convex face of the vertical cylindrical structures is preferably directed toward the exterior, and wherein the cylindrical structures 35 are spaced from one another at a distance substantially larger than their individual width. The orientation of the cylindrical structures 35 can also be foreseen to be different depending on the characteristics of the desired results.

The dihedral bodies 34 are preferably of equal number to the number of cylindrical structures and are preferably disposed circumferentially at a middle angle between the angle corresponding to neighboring cylindrical structures 35.

The apparatus having been realized in this way, then the underpressure is generated at the level of the upper opening of the duct 1 under the effect of the natural wind or of the artificial air flow which is brought to motion by the turbine 13 and which crosses successively the intermediate spaces and intervals of each of the cages such as is schematically shown in FIG. 7, where said underpressure is close to that established in the preceding case.

The value of the underpressure obtained in this way can be modified as a function of the result desired by performing a longitudinal flection bend toward the exterior more or less pronounced by the upright posts 35A of the outer cage.

The invention can be used for the ventilation of apartment buildings or for industrial buildings and for the extraction of smoke either in order to assure the draught of the heating apparatus or, alternatively, for purging, decontaminating and purifying air in buildings containing certain apparatus emitting vapors or undesirable gases, where the high yield obtained allows to reduce the size or the number of the apparatus installed, and thus reducing the investment and the operating cost. The possibilities of modified functioning in a static or mechanical way furnished by the combination of the two modules associated allow for an economical use of such a device by allowing to organize the regulation by a thermostat or by a pressure sensor of the putting into function of the motor 14 depending on the instant conditions of the ventilation needs of the building or of the draught and of the exterior climatic conditions including or not including the wind.

I claim:

1. A ventilation and extraction apparatus for buildings comprising a base element constituting a footing of a ventilation and extraction apparatus and formed by a ring of a general external truncated-cone form and suitable to be placed at an orifice of smoke ducts on buildings, wherein a contour cone face of the footing presents a continuous and smooth curve when considered in a sectional view of the footing, wherein the continuous and smooth curve exhibits an upper bulge and a lower bulge, and wherein an area of the upper bulge assumes from about 0.25 to 0.33 of a vertical extension of the footing from a top of the footing, and wherein an area of the lower bulge assumes from about 0.67 to 0.75 of the vertical extension of the footing from the top of the footing, wherein a maximum thickness of the upper bulge is from about 0.01 to 0.02 times the vertical extension of the footing, and wherein a maximum thickness of the lower bulge is from about 0.05 to 0.1 of the vertical extension of the footing;

one of a static member and a mechanical ventilation element associated with the base element and surmounting the base element.

2. The ventilation and extraction apparatus for buildings according to claim 1 wherein the mechanical ventilation element is associated with said base element and essentially formed by an opened centrifuge turbine driven by an electric motor and forming a dynamic module capable of creating a necessary air current alone or supplementing the wind, wherein the mechanical ventilation element together with the footing furnishes an adequate aerodynamic form in order to assure a higher depression in connection with said base element at the orifice of smoke ducts or ventilation ducts of a building, and wherein the continuous and smooth curve of the footing exhibits an upper inflection point at a level of from about 0.15 to 0.25 times the vertical extension of the footing from the top of the footing and a lower inflection point at a level of from about 0.45 to 0.55 from the bottom of the footing.

3. A ventilation and extraction apparatus for buildings comprising a footing placeable at an orifice of a smoke duct or a ventilation duct and formed as a ring, where a bottom line of a cross-section is disposed horizontally in a plane perpendicular to a ring axis, where an inner plane of the ring is of a conical shape expanding upwardly with a cone angle of from about 1 to 3 degrees and with an outer contour of the cross-section exhibiting an upper bulge and a lower bulge, wherein an area of the upper bulge assumes from about 0.25 to 0.33 of a vertical extension from a top of the footing, and wherein an area of the lower bulge assumes from about 0.67 to 0.75 times the vertical extension from the top of the footing, wherein a maximum thickness of the upper bulge is from about 0.01 to 0.02 times the vertical extension of the footing and wherein a maximum thickness of the lower bulge is from about 0.05 to 0.1 times the vertical extension of the footing;

an upper covering part disposed on top of the footing for enhancing a flow of an air stream through the smoke duct or the ventilation duct and for providing a cover of the footing against atmospheric deposits falling into the smoke duct or the ventilation duct.

4. The ventilation and extraction apparatus for buildings according to claim 3 wherein the outer contour of the cross-section of the footing exhibits an upper inflection point at a level of from about 0.15 to 0.25 times the vertical extension of the footing from the top of the of the footing and a lower inflection point at a level of from about 0.45 to 0.55 times the vertical extension of the footing from the bottom.

5. The ventilation and extraction apparatus for buildings according to claim 3 wherein the upper covering part comprises a mechanical ventilation element to be positioned above said footing and essentially formed by an opened centrifuge turbine driven by an electric motor and forming a dynamic module capable of creating a necessary air current alone or supplementing a wind, and wherein the mechanical ventilation element together with the footing furnishes an adequate aerodynamic form in order to assure a higher depression in connection with the footing at the orifice of the smoke ducts or ventilation ducts of a building and wherein the outer contour of the cross-section of the footing exhibits an upper inflection point at a level of from about 0.15 to 0.25 times the vertical extension of the footing from the top of the footing and a lower inflection point at a level of from about 0.45 to 0.55 times the vertical extension of the footing from the bottom.

6. The ventilation and extraction apparatus for buildings according to claim 3 wherein the upper covering part comprises a static module positioned above said footing, wherein the static module has a diameter substantially equal to an exterior diameter of said footing, wherein the static module cooperates with the footing in view of generating a venturi effect at a level of an opening of said footing under the effect of wind which sweeps around the footing, where the static module exhibits a concave surface in a form of a spheric cap at an interior surface at a center of the static module, which spheric cap supports in a rigid manner a deflection disk disposed below said spheric cap, wherein the concave surface includes an outer crown ring having a shape of a truncated cone, which truncated cone is open toward the exterior in order to generate in cooperation with said footing the venturi effect in a free space left between the footing and said static module, where the free space is such that a peripheral surface of an imaginary cylindrical ring enclosed between an upper edge of the footing and a lower face of the spheric cup is at least equal to one and a half times an open cross-section of the opening of the footing.

7. The ventilation and extraction apparatus for buildings according to claim 3, wherein the upper covering part comprises a dynamic module for obtaining a higher depression value, wherein elements forming the dynamic module are joined to the footing, wherein the dynamic module comprises an opened ferrule formed at its base by a cylindrical collar surmounted by a truncated cone, wherein an upper edge of the truncated cone is turned down toward an outside for forming a more open conical shape, wherein a free space left between said opened ferrule and the footing is such that a peripheral surface of an imaginary cylindrical ring disposed between a lower surface of the opened ferrule and a surface of an upper orifice of said footing is substantially equal to one and a half times a surface of said upper orifice;

an opened centrifuge turbine, wherein said turbine is positioned at an interior of the opened ferrule; an electric motor driving the opened centrifuge turbine.

8. The ventilation and extraction apparatus for buildings according to claim 7 wherein the upper covering part further comprising a muffle exhibiting an open truncated-cone shape open to a bottom at an obtuse angle, wherein the muffle has a large base closed except for a central opening, where the diameter of the large base is substantially equal to a diameter of the opened ferrule, wherein the opened ferrule surmounts the large base, wherein the opened ferrule cooperates with the muffle;

a collar surrounding the central opening;

a coupling connecting said turbine to the motor, wherein the coupling is disposed at a center of the collar and turns with the motor; a neck extending upwardly from a small base of said muffle, wherein the motor is disposed at an interior of the neck, and wherein a free passage of air is left between the large base of the muffle and the upper edge of the opened ferrule.

9. The ventilation and extraction apparatus for buildings according to claim 8, wherein the upper covering part is a mechanical module and further comprising a hemispherical cap covering the mechanical module, which cap leaves a free space between its inner edge and the muffle.

10. The ventilation and extraction apparatus for buildings according to claim 8 wherein the opened centrifuge turbine comprises a turbine plate having rectangular blades solidly fixed to an upper face of the turbine plate, and wherein the rectangular blades have a small height relative to their length and are placed in an oblique position with respect to a radius of said turbine plate and in position of elopement with respect to rotation direction of said turbine plate, and wherein principal blades are solidly fixed to a lower face of the turbine plate and are situated in the same orientation as the rectangular blades, and wherein the principal blades exhibit a form substantially of a half cylinder, which half cylinder is longitudinally opened and fixed to the turbine plate at a level of an upper longitudinal edge of the half cylinder, and wherein a lower longitudinal edge of the half cylinder is turned down relative to an outside of the half cylinder substantially in an extension of a diameter of the half cylinder.

11. The ventilation and extraction apparatus for buildings according to claim 10, wherein the motor drives the turbine plate by means of the coupling, wherein the coupling is formed as a rigid disk, wherein said rigid disk is furnished with perforations, and wherein the rigid disk provides a thermal insulation of the motor;

a mandrel having a center bore, which center bore of the mandrel is adjusted to a shaft of the motor and wherein the mandrel is carried at an upper face and at the center of the rigid disk;

at least three support columns carried by the rigid disk at a lower face of the rigid disk and uniformly distributed on a circumference disposed relatively remote to a center of the mandrel, and wherein the turbine plate is affixed to the three support columns.

12. The ventilation and extraction apparatus for buildings according to claim 3 wherein the upper covering part is a mechanical module and further comprising a muffle exhibiting an open truncated-cone shape open to a bottom at an obtuse angle, wherein the muffle has a large base closed except for a central opening;

an opened centrifuge turbine, wherein said turbine is positioned at an interior of an opened ferrule; an electric motor connected to and driving the opened centrifuge turbine;

an inner substantially cylindrical cage;

an outer substantially cylindrical cage disposed concentrically to the inner substantially cylindrical cage, wherein the inner substantially cylindrical cage and the outer substantially cylindrical cage surround the opened centrifuge turbine and are placed between the muffle and the footing, wherein the inner substantially cylindrical cage is formed by vertical dihedral bodies exhibiting an obtuse angle, which dihedral bodies are distributed surrounding the opened centrifuge turbine, wherein an edge of each of the dihedral bodies is oriented toward outside, and wherein the dihedral bodies are regularly spaced between one another at a distance substantially smaller than a size of each of the dihedral bodies, and wherein the outer substantially cylindrical cage is formed by vertical cylindrical sectors, where a convex face of the vertical cylindrical sectors is oriented toward outside, and where the vertical cylindrical sectors are spaced between one another at a distance which is substantially larger than a width of the outer cylindrical sectors.

13. The ventilation and extraction apparatus for buildings according to claim 12 further comprising a coupling formed by a rigid disk and connecting said opened centrifuge turbine to the motor, wherein the motor drives the opened centrifuge turbine by means of the coupling, wherein said rigid disk is furnished with perforations, and wherein the rigid disk provides a thermal insulation of the motor;

a mandrel having a center bore, which center bore of the mandrel is adjusted to a shaft of the motor and wherein the mandrel is carried at an upper face and at a center of the rigid disk;

at least three support columns carried by the rigid disk at a lower face of the rigid disk and uniformly distributed on a circumference disposed relatively remote to a center of the mandrel, and wherein the opened centrifuge turbine is affixed to the three support columns.

14. Improvements to smoke-extraction apparatus and ventilation apparatus for buildings allowing to assure a better steadiness of a depression factor at an opening of smoke ducts or ventilation ducts of buildings under an effect of different winds, falling or rising, by way of a modular device including a base element essentially formed by a ring of a general external truncated-cone form, which base element is placed at an orifice of smoke ducts;

one of a static member and mechanical ventilation elements associated to the base element, wherein the static member surmounts the base element and which static member constitutes a static module capable of providing an underpressure in said smoke ducts under only an effect of wind, which sweeps through the modular device, wherein the mechanical ventilation elements are formed by an opened centrifuge turbine driven by an electric motor and forming a dynamic module capable of creating a necessary air current alone or supplementing the wind in order to assure a higher depression in connection with said base element, wherein the base element creating a footing (2) has a continuous and smooth contour curve when considered in a sectional view of the footing, wherein the continuous and smooth curve exhibits an upper bulge and a lower bulge, and wherein an area of the upper bulge assumes from about 0.25 to 0.33 of a vertical extension of the footing from a top of the footing, and wherein an area of the lower bulge assumes from about 0.67 to 0.75 of the vertical extension of the footing from the top of the footing, wherein a maximum thickness of the upper bulge is from about 0.01 to 0.02 times the vertical extension of the footing, and wherein a maximum thickness of the lower bulge is from about 0.05 to 0.1 of the vertical extension of the footing.

15. Improvements to smoke-extraction apparatus or ventilation apparatus for buildings according to claim 14, characterized in that elements forming the static module (5) in combination with said footing (2) have a diameter substantially equal to an exterior diameter of said footing (2), where the static module (5) is mounted on the footing (2), and where the static module (5) cooperates with the footing (2) in view of generating a venturi effect at a level of an opening of said footing (2) under an effect of wind which sweeps around the footing, where the elements forming the static module (5) exhibits a concave surface (7) in a form of a spheric cap at an interior surface at a center of the static module (5), which spheric cap supports in a rigid manner a deflection disk (11), wherein the concave surface exhibits an outer crown ring (8) of a shape of a truncated cone, which truncated cone is open toward the exterior in order to generate with said footing (2) the venturi effect in a free space left between the footing (2) and said static module (5), where the free space is such that a peripheral surface of an imaginary cylindrical ring enclosed between an upper edge (6) of the footing (2) and a lower face of the static module (5) is at least equal to one and a half times a surface of the opening of the footing.

16. Improvements to smoke-extraction apparatus or ventilation apparatus for buildings according to claim 14, characterized in that, in order to obtain in certain situation a higher depression value, the dynamic module (12) is joined to the footing (2) by replacing the static module (5), where the dynamic module (12) comprises an opened centrifuge turbine (13) driven by the electric motor (14), where said opened centrifuge turbine is put into service at an interior of an opened ferrule (15) formed at its base by a cylindrical collar (16) surmounted by a truncated cone (17), where an upper edge (18) of the truncated cone (17) is turned down toward outside for forming a more open conical shape, where a free space left between said opened ferrule (15) and the footing (2), which is surmounted by the opened ferrule (15), is such that a peripheral surface of an imaginary cylindrical ring disposed between a lower surface of the opened ferrule (15) and a surface of an upper orifice of said footing is substantially equal to one and a half times a surface of said upper orifice.

17. Improvements to smoke-extraction apparatus or ventilation apparatus for buildings according to claim 16, characterized in that the opened ferrule (15) cooperates with a muffle (19), which muffle (19) exhibits an open truncated-cone shape open to a bottom at an obtuse angle wherein a large base of the muffle (19) is closed except for a central opening, where a diameter of the large base is substantially equal to a diameter of the opened ferrule (15), which opened ferrule (15) surmounts the large base, which the central opening is surrounded by a collar (23), wherein a coupling (22) of said opened turbine (13) is disposed at a center of the collar (23) and turns with the motor (14), wherein the electric motor (14) is disposed at an interior of a neck (21), which neck (21) extends upwardly from a small base of said muffle (19), and wherein a free passage of air is left between the large base of the muffle (19) and the upper edge of the truncated cone (17).

18. Improvements to smoke-extraction apparatus or ventilation apparatus for buildings according to claim 17, characterized in that the mechanical module (12) is covered by a hemispherical cap (24), which cap (24) leaves a free space between its inner edge and the muffle (19).

19. Improvements to smoke-extraction apparatus or ventilation apparatus for buildings according to one of the preceding claims 17, characterized in that the opened centrifuge turbine (13) comprises rectangular blades (26) solidly fixed to an upper face of a plate (25) of said centrifuge turbine (13), and wherein the rectangular blades (26) have a small height relative to their length and are placed in an oblique position with respect to a radius of said plate (25) and in position of elopement with respect to a rotation direction of said turbine, and wherein principal blades (27) are solidly fixed to a lower face of the plate (25) and are situated in the same orientation as the rectangular blades (26), and wherein the principal blades (27) exhibit a form substantially of a half cylinder (36), which half cylinder (36) is longitudinally opened and fixed to the plate (25) at a level of an upper longitudinal edge of the half cylinder (36), and wherein its lower longitudinal edge (28) is turned down to outside of the half cylinder substantially in an extension of its diameter.

20. Improvements to smoke-extraction apparatus or ventilation apparatus for buildings according to claim 14, characterized in that the opened centrifuge turbine (13) is driven by the electric motor (14), comprised in the dynamic module (12), and is surrounded by an inner cage (132) and an outer cage (33) fixed concentrically and placed between the muffle (19) and the footing (2), wherein the inner cage (132) is formed by vertical dihedral bodies (34) exhibiting an obtuse angle, which dihedral bodies (34) are distributed surrounding the opened centrifuge turbine (13), where an edge of the dihedral bodies (34) is oriented toward outside, and which dihedral bodies are regularly spaced between one another at a distance substantially smaller than a size of each of the dihedral bodies, and wherein the outer cage (33) is formed by vertical cylindrical sectors (35), where the convex face of the vertical cylindrical sectors (35) is oriented toward outside, and where the vertical cylindrical sectors (35) are spaced between one another at a distance which is substantially larger than a width of the vertical cylindrical sectors (35).

21. Improvements to smoke-extraction apparatus or ventilation apparatus for buildings according to claim 20, characterized in that the electric motor (14) is connected to and drives the opened vertical turbine (13) by means of a coupling (22) formed by a rigid disk (29), which rigid disk (29) provides a thermal insulation, and which rigid disk (29) carries at its upper face and at its center a mandrel (30) having a center bore, which center bore of the mandrel (30) is adjusted to a shaft of the electric motor, and which rigid disk (29) carries at its lower face at least three support columns (31) uniformly distributed on a circumference disposed relatively remote to the center of the mandrel (30) and to which the opened centrifuge turbine (13) is affixed, and where said rigid disk (29) is additionally furnished with perforations (32).

* * * * *